US011229339B2

(12) United States Patent
Cho et al.

(10) Patent No.: US 11,229,339 B2
(45) **Date of Patent: *Jan. 25, 2022**

(54) STATION

(71) Applicant: Samsung Electronics Co., Ltd., Suwon-si (KR)

(72) Inventors: Youngjun Cho, Suwon-si (KR); Seokbong Baek, Suwon-si (KR); Byeongwoo Ahn, Suwon-si (KR); Yunwon Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/230,301

(22) Filed: Apr. 14, 2021

(65) Prior Publication Data

US 2021/0228037 A1 Jul. 29, 2021

Related U.S. Application Data

(63) Continuation of application No. 16/902,839, filed on Jun. 16, 2020, now Pat. No. 11,006,797.

(30) Foreign Application Priority Data

Jan. 9, 2020 (KR) ..... 10-2020-0002998

(51) Int. Cl.
*A47L 9/10* (2006.01)
*A47L 9/14* (2006.01)

(52) U.S. Cl.
CPC ..... *A47L 9/1445* (2013.01); *A47L 9/1472* (2013.01)

(58) Field of Classification Search
CPC ..... B01D 45/00; A47L 9/1683; A47L 9/1409; A47L 9/122; A47L 9/149; A47L 9/1445
(Continued)

(56) References Cited

U.S. PATENT DOCUMENTS 4,452,618 A 6/1984 Kuplas
4,766,639 A 8/1988 Lindquist et al.
(Continued)

FOREIGN PATENT DOCUMENTS

CN 1575720 A 2/2005
CN 202128398 U 2/2012
(Continued)

OTHER PUBLICATIONS

Korean Office Action dated Apr. 29, 2020, issued in Korean Application No. 10-2020-0002998.
(Continued)

*Primary Examiner* — Minh Chau T Pham
(74) *Attorney, Agent, or Firm* — Jefferson IP Law, LLP

(57) ABSTRACT

A station for a cleaning device is provided. The station includes an accommodation chamber configured to be docked with the dust canister, a housing configured to have a dust bag disposed therein, a cover configured to open and close one region of the housing, a holder configured to be detachable to the dust bag and selectively communicate the dust bag with the accommodation chamber, and a lever configured to have one end disposed in one region of the housing and rotate in a first direction to selectively interfere with the cover. The lever rotates in a second direction opposite to the first direction to close the cover based on the dust bag being mounted on the holder and in communication with the accommodation chamber.

16 Claims, 10 Drawing Sheets

(58) Field of Classification Search
USPC ..... 55/356, 357, 385.1, 429, 467, 345, 337, 55/447; 15/347, 352, 353
See application file for complete search history.

(56) References Cited

U.S. PATENT DOCUMENTS

| | | | |
|---|---|---|---|
| 5,907,889 | A | 6/1999 | Fukushima et al. |
| 6,033,451 | A | 3/2000 | Fish et al. |
| 6,406,507 | B1 | 6/2002 | Paterson et al. |
| 7,024,724 | B2 | 4/2006 | Ponjican et al. |
| 7,175,682 | B2 | 2/2007 | Nakai et al. |
| 7,181,803 | B2 | 2/2007 | Park et al. |
| 7,377,007 | B2 | 5/2008 | Best |
| 8,021,453 | B2 | 9/2011 | Howes |
| 8,070,845 | B2 | 12/2011 | Roehm |
| 8,163,051 | B2 | 4/2012 | Yun et al. |
| 8,292,979 | B2 | 10/2012 | Conrad |
| 8,402,599 | B2 | 3/2013 | Charlton et al. |
| 8,413,293 | B2 | 4/2013 | Dyck et al. |
| 8,640,304 | B2 | 2/2014 | Conrad |
| 8,728,188 | B2 | 5/2014 | Kim et al. |
| 8,763,201 | B2 | 7/2014 | Kim et al. |
| 8,925,145 | B2 | 1/2015 | Wilson |
| 9,074,622 | B2 | 7/2015 | Morgan et al. |
| 10,485,394 | B2 * | 11/2019 | Hu ..... A47L 9/1683 |
| 11,006,797 | B1 * | 5/2021 | Cho ..... A47L 9/1445 |
| 2007/0245511 | A1 | 10/2007 | Hahm et al. |
| 2012/0304415 | A1 | 12/2012 | Bosses |
| 2016/0106284 | A1 | 4/2016 | Mantyla et al. |
| 2016/0374528 | A1 | 12/2016 | Morin et al. |
| 2018/0177358 | A1 | 6/2018 | Conrad |
| 2019/0335968 | A1 | 11/2019 | Harting et al. |

FOREIGN PATENT DOCUMENTS

| | | | |
|---|---|---|---|
| CN | 207679385 | U | 8/2018 |
| JP | 3424154 | B2 | 7/2003 |
| JP | 2017-189453 | A | 10/2017 |
| KR | 10-0176045 | B1 | 2/1999 |
| KR | 10-0194382 | B1 | 6/1999 |
| KR | 10-0223485 | B1 | 10/1999 |
| KR | 10-2001-0054948 | A | 7/2001 |

OTHER PUBLICATIONS

Notice of Allowance issued by Korean Intellectual Property Office in Korean Application No. 10-2020-0002998, dated Aug. 18, 2020.
Search report and written opinion dated Sep. 28, 2020 issued in International Application No. PCT/KR2020/006828.

* cited by examiner

STATION

CROSS-REFERENCE TO RELATED APPLICATION(S)

This application is a continuation application of prior application Ser. No. 16/902,839, filed on Jun. 16, 2020, now U.S. Pat. No. 11,006,797, which claims priority under 35 U.S.C. § 119 of a Korean patent application number 10-2020-0002998, filed on Jan. 9, 2020, in the Korean Intellectual Property Office, the disclosure of which is incorporated by reference herein in its entirety.

BACKGROUND

1. Field

The disclosure relates to a station. More particularly, the disclosure relates to a station in which a recognition structure of a dust bag and a holder is improved and unintentional unlocking of the holder is prevented.

2. Description of Related Art

A vacuum cleaner is an apparatus that does the cleaning while moving by a user's direct manipulation or moving a certain area on its own without a user's separate manipulation. The station is an apparatus for removing dust collected in a dust canister of the vacuum cleaner, and is fixedly disposed at a predetermined position.

However, if the station sucks dust in a state in which a dust bag for collecting the dust in the station is not disposed in place, there was a problem in that the station is damaged by the dust being scattered in the station or the dust being sucked into a motor that sucks the dust.

Further, if the dust inside the dust bag of the station is full, there was a problem in that a holder in which the dust bag is mounted is unlocked and the dust is leaked.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a station dockable with a dust canister of a vacuum cleaner.

Additional aspects will be set forth in part in the description which follows and, in part, will be apparent from the description, or may be learned by practice of the presented embodiments.

In accordance with an aspect of the disclosure, a station is provided. The station includes an accommodation chamber configured to be docked with the dust canister, a housing configured to have a dust bag disposed therein, a cover configured to open and close one region of the housing, a holder configured to be detachable to the dust bag and selectively communicate the dust bag with the accommodation chamber, and a lever configured to have one end disposed in the one region of the housing and rotate in a first direction to selectively interfere with the cover, wherein the lever rotates in a second direction opposite to the first direction to close the cover based on the dust bag being mounted on the holder and in communication with the accommodation chamber.

The cover includes a support member disposed to protrude toward an inside of the housing to support the holder.

The support member includes a first support member supporting a lower surface of the holder and a second support member supporting a side surface of the holder.

The holder includes a locking bar in which a fastening member disposed at an edge is coupled to an accommodation groove formed in the housing, and the support member supports the fastening member.

The holder has one end rotatably coupled in the housing and another end coupled to an accommodation groove formed in the housing.

The holder is pushed by the lever, based on one pressed end of the lever, to release a fastening with the accommodation groove, and the holder is rotated in the second direction.

The cover includes a rib that is disposed to protrude toward the inside of the housing, and interfere with the lever rotated in the first direction.

The holder includes a sliding groove on one surface on which the dust bag is slidingly mounted, and an inclined member having one region disposed in a section in which the dust bag slides and interferes with the dust bag based on the dust bag being mounted on the holder to be rotated in the second direction.

The inclined member includes one surface formed to be inclined in a direction in which the dust bag slides.

The lever is rotatably coupled in the housing and includes a torsion spring that provides an elastic force in the first direction.

The cover includes one end rotatably connected to the housing.

A driving apparatus configured to generate an air flow from the dust canister to the dust bag based on the dust canister docked with the accommodation chamber.

The dust canister includes a canister cover that opens and closes one region, and the driving apparatus opens the canister cover based on the dust canister being docked with the accommodation chamber.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
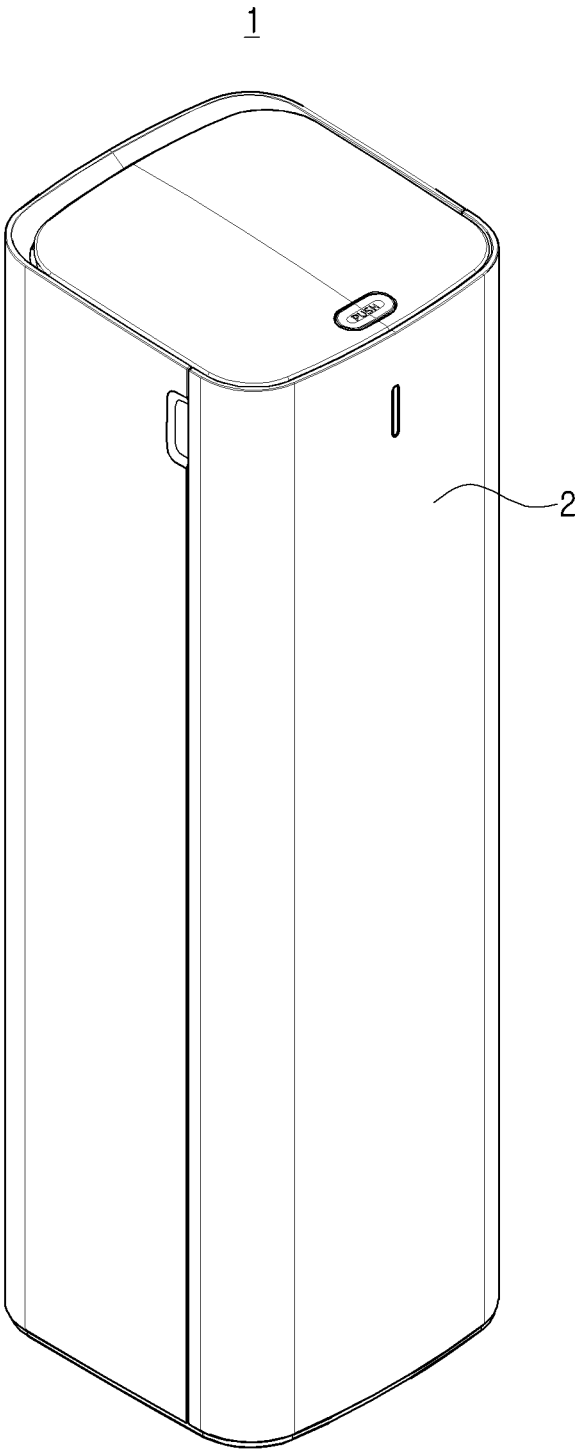
FIG. 1 is a perspective view illustrating a station according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the disclosure, an expression "have", "may have", "include", "may include", or the like, indicates an existence of a corresponding feature (for example, a numerical value, a function, an operation, a component such as a part, or the like), and does not exclude an existence of an additional feature.

Terms such as first and second may be used to describe various components, but the components should not be limited by the terms. The terms may be used only for the purpose of distinguishing one component from other components. For example, without departing from the scope of the disclosure, a first component may be referred to as a second component, and similarly, the second component may also be referred to as the first component.

In addition, terms such as 'front surface', 'rear surface', 'upper surface', 'lower surface', 'side surface', 'left side', 'right side', 'upper portion', and 'lower portion' used in the disclosure are defined based on the drawings, and the shape and position of each component are not limited by the terms.

In addition, in the specification, components necessary for description of each embodiment of the disclosure are described, and thus are not necessarily limited thereto. Therefore, some components may be changed or omitted, and other components may be added. In addition, the components may be disposed to be distributed in different independent apparatuses.

Further, hereinafter, embodiments of the disclosure will be described in detail with reference to the accompanying drawings and the contents described in the accompanying drawings, but the disclosure is not limited to or limited by the embodiments.

The disclosure may provide a station 1 in which a recognition structure of a dust bag 400 and a holder 300 is improved and unintentional unlocking of the holder 300 is prevented.

Hereinafter, a structure of the station 1 according to an embodiment of the disclosure will be described with reference to FIGS. 1 to 3.

FIG. 1 is a perspective view illustrating a station 1 according to an embodiment of the disclosure.

Figure 2:
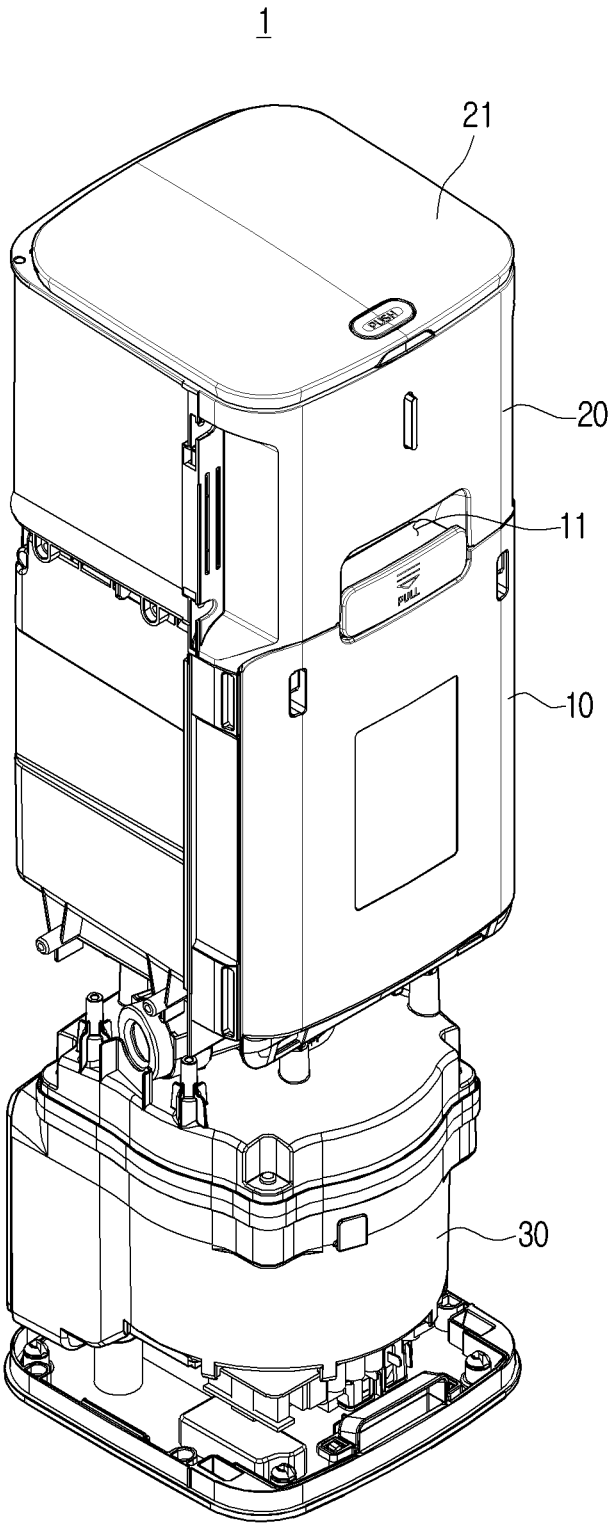
FIG. 2 is a perspective view illustrating the station in which a case is removed from a structure of FIG. 1 according to an embodiment of the disclosure.

FIG. 2 is a perspective view illustrating the station 1 in which a case 2 is removed from a structure of FIG. 1 according to an embodiment of the disclosure.

Figure 3:
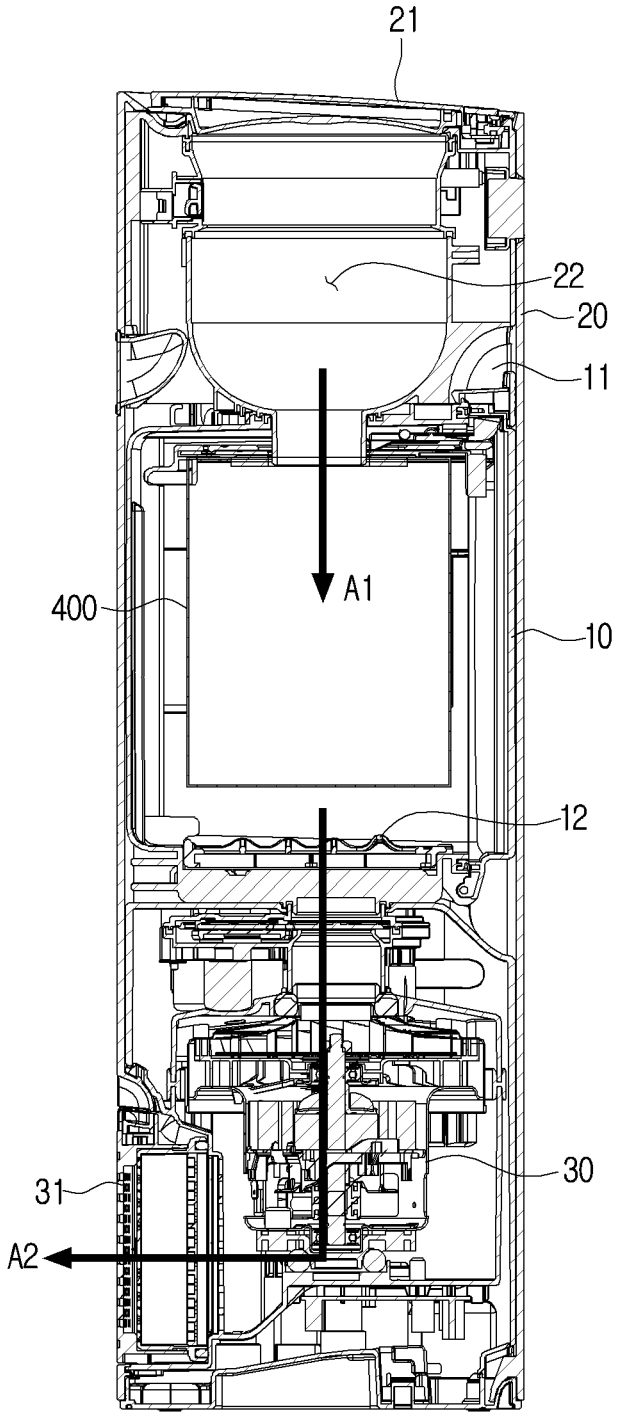
FIG. 3 is a cross-sectional view illustrating the station according to an embodiment of the disclosure.

FIG. 3 is a cross-sectional view illustrating the station 1 according to all embodiment of the disclosure.

The station 1 may be an apparatus that is docked with a dust canister of a vacuum cleaner to suck the dust collected in the dust canister into the dust bag 400. The type of vacuum cleaner in which the dust container is docked may be a canister type vacuum cleaner having a main body and a suction port connected by a rubber hose or pipe, an upright type vacuum cleaner in which a rotation brush rotates to suck the dust, or a cylindrical type vacuum cleaner, but is not limited thereto, and may also be a robotic vacuum cleaner.

Specifically, the station 1 according to an embodiment of the disclosure may include a case 2, an accommodation chamber 20, a housing 10, and a driving apparatus 30.

The case 2 may form an outer shape of the station 1 and may protect various electronic apparatuses and mechanical apparatuses disposed inside the station 1. The shape of the case 2 may be various, and is sufficient if it is possible to prevent foreign substances from entering the station 1 from the outside of the station 1.

The accommodation chamber 20 may include an accommodation space 22 in which the dust canister of the vacuum cleaner may be accommodated. Specifically, a user may dock the dust canister with the station 1 by opening an upper cover 21 of the accommodation chamber 20 and accommodating the dust canister of the vacuum cleaner in the accommodation space 22.

The entire dust canister of the vacuum cleaner may be accommodated and in the accommodation chamber 20 and docked therewith, and only a portion of the dust canister may be accommodated in the accommodation chamber 20 and docked therewith. In addition, all or portion of the robotic vacuum cleaner may be docked directly with the accommodation chamber 20.

The housing 10 may form a space in which the dust bag 400 is disposed. That is, an inner space of the housing 10 may accommodate the dust bag 400 that communicates with the accommodation chamber 20 and collects dust flowing from the accommodation chamber 20.

The shape of the housing 10 is illustrated as a substantially rectangular parallelepiped shape, but is not limited thereto, and may be various, and may be disposed at various positions of the station 1 as necessary.

The housing 10 may have a handle region 11 that is an empty space in which the user may put their hands to open one region of the housing 10 on an outer surface thereof. The handle region 11 may be a groove shape that is drawn from the outer surface of the housing 10 toward the inside, but is not limited thereto.

An auxiliary filter 12 may be disposed at a region where the housing 10 and the driving apparatus 30 are connected. The auxiliary filter 12 may be formed of a non-woven fabric, or may be formed in the form of a metal film or a metal mesh in which eyes of the filter are very tightly perforated, but is not limited thereto, and a Hepa filter or an Ulfa filter. The auxiliary filter 12 may prevent a problem that the station 1 is damaged by the dust being sucked into the driving apparatus 30.

The driving apparatus 30 may be connected to the inner space of the housing 10 to provide a driving force capable of sucking the dust in the dust canister docked with the station 1. Specifically, when the dust canister is docked with the accommodation chamber 20, the driving apparatus 30 may generate air flow from the dust canister to the dust bag 400 to allow the dust to be sucked into the dust bag 400.

For example, the driving apparatus 30 may include a motor and a fan for providing the driving force for sucking the dust in the dust canister into the dust bag 400. Accordingly, as illustrated in FIG. 3, the driving apparatus 30 may form a suction flow path A1 that sucks the dust into the dust bag 400 and a discharge flow path A2 through which air after the dust is removed from the suction flow path A1 is discharged outside the station 1.

In addition, the discharge flow path A2 may discharge clean air to the outside of the station 1 through a primary filter due to the filter of the dust bag 400 itself and a filter disposed in a discharge port 31.

In addition, the driving apparatus 30 may open a canister cover that opens and closes one region of the docked dust canister. Specifically, in the case in which the dust canister is docked with the accommodation chamber 20, if the user pushes a driving button (not illustrated), the driving apparatus 30 may open the canister cover of the dust canister and generate air flow from the dust canister to the dust bag 400. On the other hand, a space in which the canister cover of the dust canister may be opened may be formed inside the station 1.

Accordingly, the user does not have to directly open the canister cover of the dust canister, and it is possible to prevent the dust from flowing out of the dust canister in the process of docking the dust canister of the vacuum cleaner with the station 1.

Hereinafter, a mounting structure of the dust bag 400 according to an embodiment of the disclosure will be described with reference to FIGS. 4 to 7.

Figure 4:
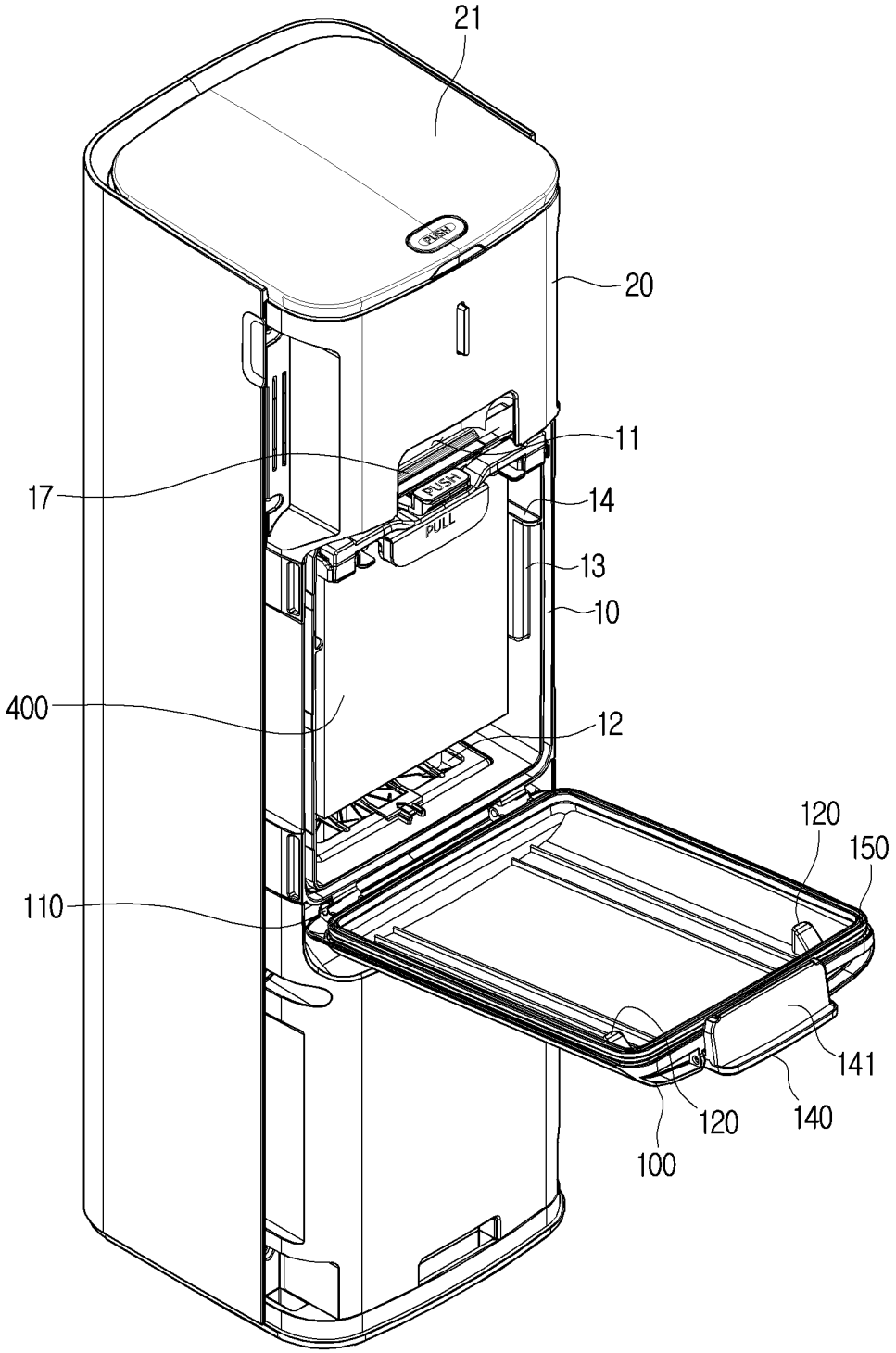
FIG. 4 is a perspective view illustrating the station in which a cover is opened according to an embodiment of the disclosure.

FIG. 4 is a perspective view illustrating the station 1 in which a cover 100 is opened according to an embodiment of the disclosure.

Figure 5:
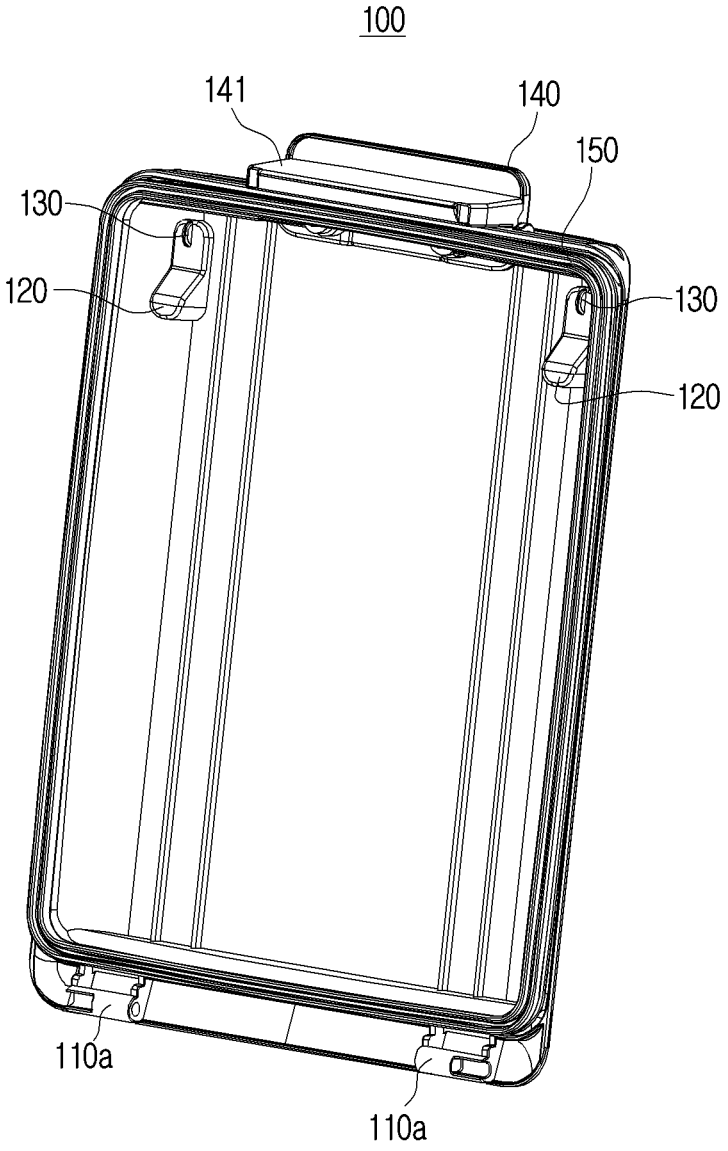
FIG. 5 is a perspective view illustrating a cover according to an embodiment of the disclosure.

FIG. 5 is a perspective view illustrating the cover 100 according to an embodiment of the disclosure.

Figure 6:
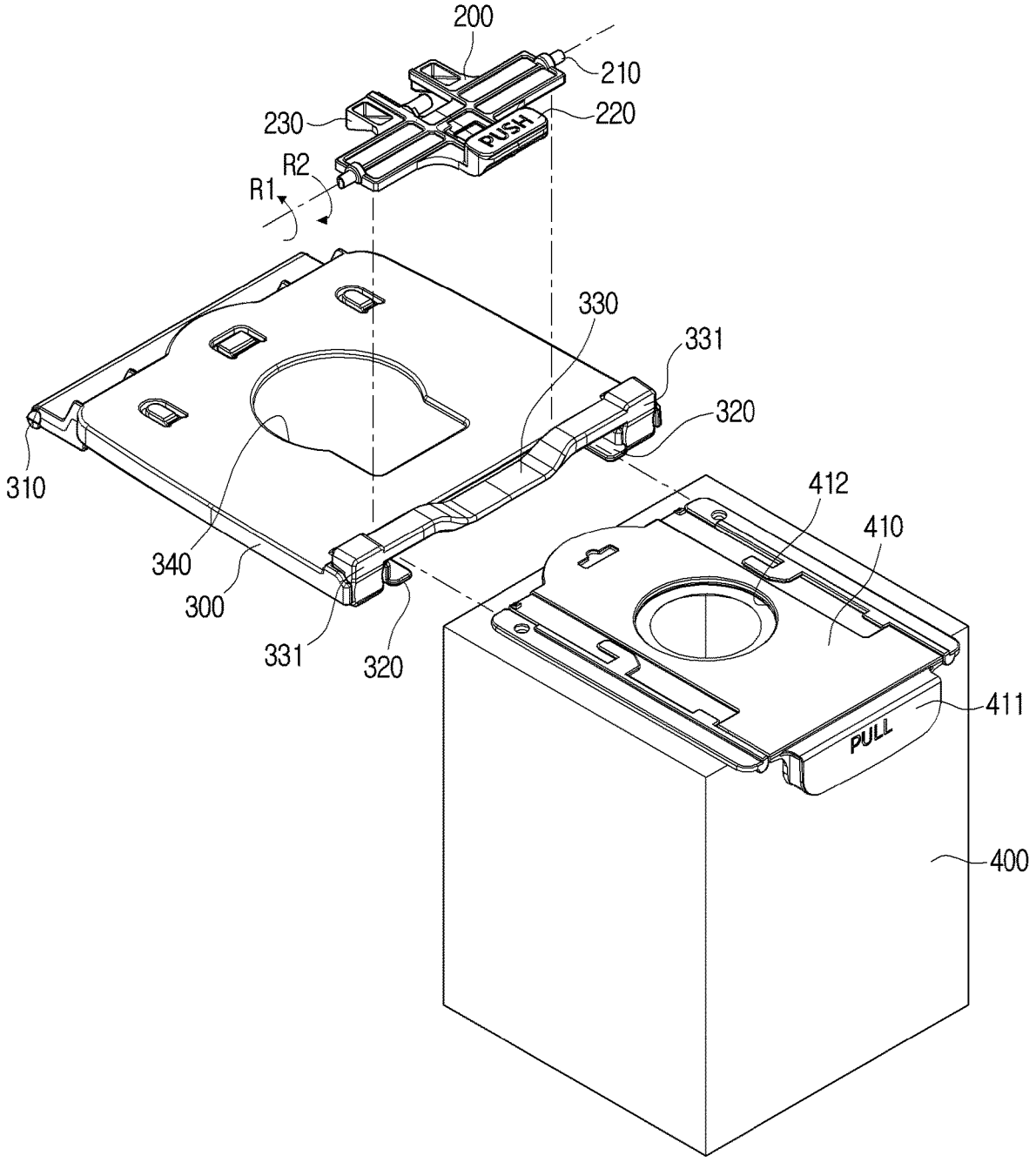
FIG. 6 is an exploded perspective view illustrating a lever, a holder, and a dust bag according to an embodiment of the disclosure.

FIG. 6 is an exploded perspective view illustrating a lever 200, a holder 300, and a dust bag 400 according to an embodiment of the disclosure.

Figure 7:
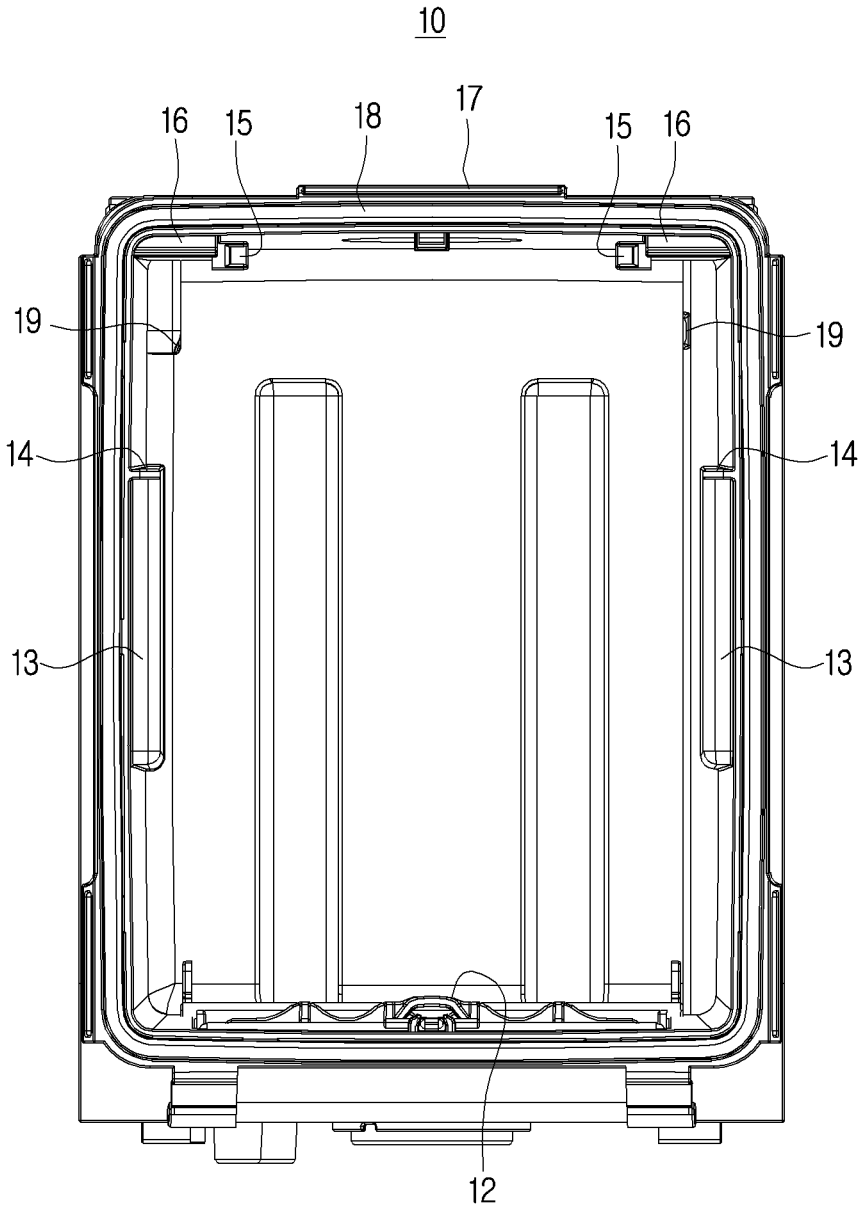
FIG. 7 is a front view illustrating the housing according to an embodiment of the disclosure.

FIG. 7 is a front view illustrating a housing 10 according to an embodiment of the disclosure.

The station 1 according to an embodiment of the disclosure may include a cover 100, a holder 300 on which the dust bag 400 is mounted, and a lever 200.

The cover 100 opens and closes one region of the housing 10 and may include an insertion groove 110*a*, support members 120 and 130, a handle 140 of the cover 100, and a rib 150.

The insertion groove 110*a* is disposed at one end of the cover 100 and may be inserted with a rotation protrusion of the cover 100 disposed at the housing 10 side to connect the cover 100 and the housing 10. The cover 100 may open and close one region of the housing 10 by rotating about a rotation shaft of the cover 100 formed by the rotation protraction of the cover 100 and the insertion groove 110*a*.

Specifically, the rotation shaft of the cover 100 may be formed by inserting the rotation protrusion of the cover 100 disposed on the housing 10 side into the insertion groove 110*a* disposed at one end of the cover 100, but is not limited thereto, and may also be formed by inserting the rotation protrusion disposed on the cover 100 side into the insertion groove 110*a* disposed at the housing 10 side.

The support members 120 and 130 may be disposed to protrude toward the inside of the housing 10 to support the holder 300. The support members 120 and 130 may include a first support member 120 supporting a lower surface of the holder 300 and a second support member 130 supporting a side surface of the holder 300. The first support member 120 may be formed to have one surface formed to be inclined, and the second support member 130 may be formed to have a semi-circular cross-section.

The first support member 120 and the second support member 130 may be integrally formed, and may be formed in two on both upper edges of a rear surface of the cover 100, but are not limited thereto. The specific functions of the support members 120 and 130 will be described later with reference to FIG. 8.

The handle 140 of the cover 100 may be disposed at an upper side of the cover 100 corresponding to the handle region 11 of the housing 10, and may be connected to rotate relative to a body of the cover 100. The user may release a fastening of a hook 141 and a fastening protrusion by inserting the hand into the handle region 11 and pulling and rotating the handle 140 of the cover 100. Accordingly, the cover 100 may rotate about the rotation shaft of the cover 100 to open one region of the housing 10.

The hook 141 may be snap-coupled to the fastening protrusion formed on the housing 10 to allow the cover 100 to close one region of the housing 10. The hook 141 may be more easily snap-coupled to the fastening protrusion by one surface formed to be inclined.

The hook 141 is integrally formed with the handle 140 of the cover 100 and may rotate relative to the body of the cover 100. Accordingly, because the hook 141 and the fastening protrusion may be easily fastened or unfastened, the cover 100 may easily open and close one region of the housing 10.

The rib 150 may be disposed to protrude from the rear surface of the cover 100 toward the inside of the housing 10. The rib 150 may be formed along the edge of the rear surface of the cover 100. The specific shape and function of the rib 150 will be described later with reference to FIGS. 9 and 10.

The holder 300 may include a holder rotation protrusion 310, a sliding groove 320, and a locking bar 330.

The holder rotation protrusion 310 may be inserted into a holder connection groove 19 disposed in the housing 10 to form a holder rotation shaft. The holder 300 may be rotatably connected to the housing 10 by the holder rotation protrusion 310, and the holder 300 may rotate about the holder rotation shaft. Accordingly, the holder 300 may selectively communicate the dust bag 400 to the accommodation chamber 20.

The sliding groove 320 is formed in one surface of the holder 300, and the dust bag 400 may be mounted on the holder 300 through the sliding groove 320. Specifically, the dust bag 400 may be mounted on the holder 300 by a fixing plate 410 inserted along a pair of sliding grooves 320 of the holder 300.

The other end of the holder 300 may be fastened to an accommodation groove 16 formed in the housing 10. Specifically, the holder 300 may include a locking bar 330 disposed at the other end in a width direction of the holder 300, and the locking bar 330 may include fastening members 331 fastened to the accommodation groove 16 of the housing 10 at both edges thereof.

A central region of the locking bar 330 may have a concave shape and may contact a lower surface of a button member 220 of the lever 200, and an edge region thereof may include the fastening members 331 to be fastened to the accommodation groove 16 of the housing 10. The structure in which the fastening members 331 are fastened to the accommodation groove 16 will be described later in detail with reference to FIG. 8.

The dust bag 400, which is a product having a standard matched to the station 1, may communicate with the accommodation chamber 20, and may include a fixing plate 410 in which an inlet 412 is formed. In addition, the dust bag 400 may have a dust filter function of a predetermined level or higher. Therefore, even if the dust is introduced into the dust bag 400, the dust may be filtered by the outer surface of the dust bag 400, and air that the dust is filtered may pass through the dust bag 400 and be discharged to the outside of the station 1 by the driving apparatus 30.

The dust bag 400 may be mounted on the holder 300 by slidingly inserting the fixing plate 410 disposed on one surface into a pair of sliding grooves 320 of the holder 300. In addition, the user may easily detach the dust bag 400 from the holder 300 by pulling a dust bag handle 411 of the dust bag 400 formed at one end of the fixing plate 410.

The lever 200 may include lever rotation protrusions 210, a button member 220, and an inclined member 230.

The lever rotation protrusions 210 may be disposed on both side surfaces of the lever 200 to connect the lever 200 and the housing 10, and the lever 200 may rotate about the lever rotation protrusions 210. Specifically, the lever rotation protrusions 210 are inserted into a lever fastening groove disposed on an upper side in the housing 10 so that the lever 200 may be rotatably connected to the housing 10.

The button member 220 may be formed at one end of the lever 200 and disposed in one region where the housing 10 is opened. In addition, the button member 220 may be rotated in a first direction R1 spaced apart from the holder 300 to selectively interfere with the cover 100, and the cover 100 may not close one region of the housing 10.

In addition, when the button member 220 is pressed in a second direction R2 toward the holder 300, the lever 200 formed integrally with the button member 220 may rotate in the second direction R2, and the holder 300 may be pushed by the lever 200 so that the fastening with the accommodation groove 16 may be released.

Specifically, as the central region of the locking bar 330 that is in contact with the lower surface of the button member 220 is pushed in the second direction R2 by the lever 200, the fastening between the fastening member 331 integrally formed with the locking bar 330 and the accommodation groove 16 may be released. The holder 300 in which the fastening is released may rotate in the second direction R2 about the holder rotation protrusion 310, until the lower surface is caught by an upper surface 14 of the holder support protrusion 13 formed to protrude to the inside of the housing 10.

The inclined member 230 has one region disposed in a section in which the dust bag 400 is slidingly mounted on the holder 300, and may interfere with the dust bag 400 and rotate in the second direction R2 when the dust bag 400 is mounted on the holder 300.

In addition, the inclined member 230 is formed to be inclined in a direction in which the dust bag 400 slides, and if the inclined member 230 interferes with the dust bag 400 that is slidingly mounted, the inclined member 230 may rotate more easily in the second direction R2.

Accordingly, the lever 200 formed integrally with the inclined member 230 and rotated together in the second direction R2 may not interfere with the cover 100, and the cover 100 may close one region of the housing 10.

Hereinafter, a supporting structure of the holder 300 according to an embodiment of the disclosure will be described with reference to FIG. 8.

Figure 8:
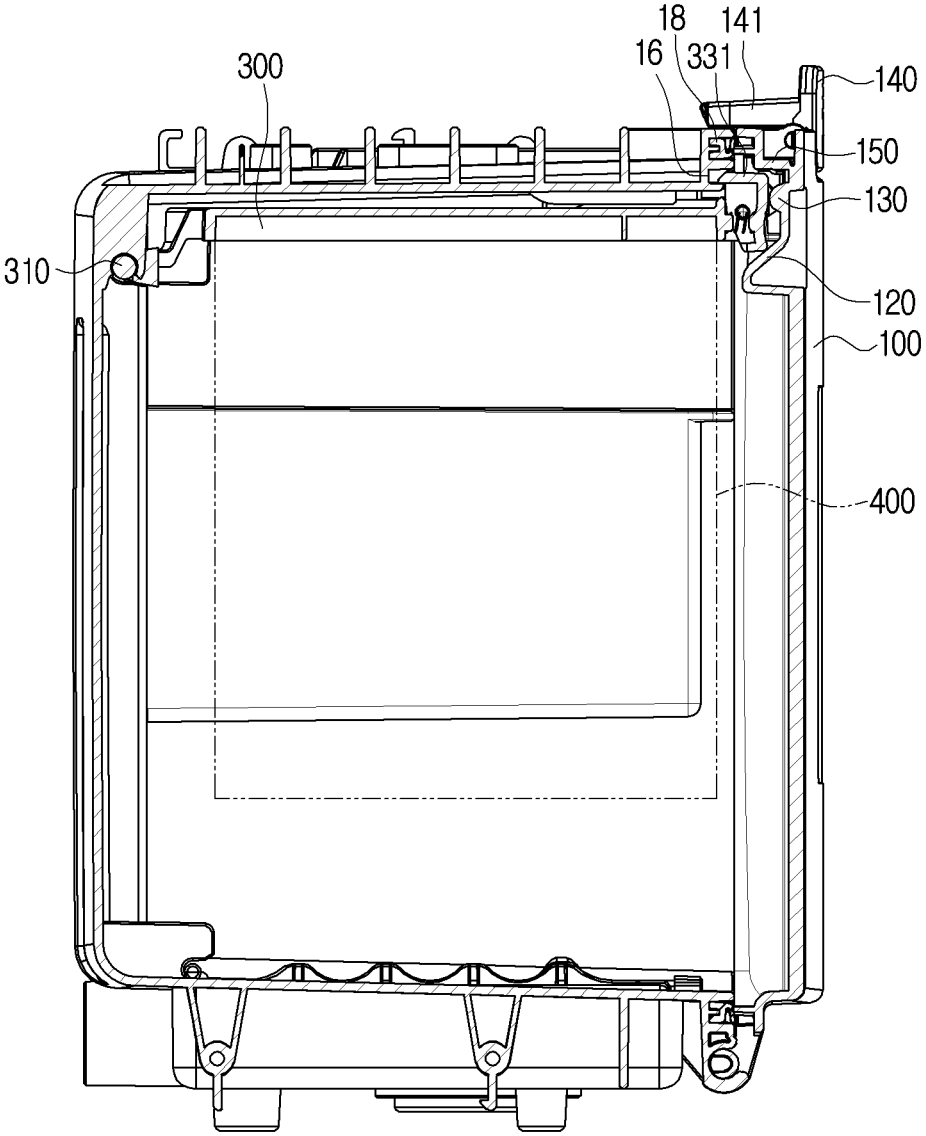
FIG. 8 is a cross-sectional view illustrating the housing in which the cover is closed according to an embodiment of the disclosure.

FIG. 8 is a cross-sectional view illustrating a housing 10 in which a cover 100 is closed according to an embodiment of the disclosure.

Referring to FIG. 8, in the case in which the dust bag 400 is mounted on the holder 300 and communicates with the accommodation chamber 20, the inclined member 230 of the lever 200 interferes with the dust bag 400 and the lever 200 rotates in the second direction R2 so as to be disposed parallel to the holder 300, and the cover 100 may thus close one region of the housing 10 without interfering with the lever 200.

Specifically, when the cover 100 rotates, the rib 150 protruding from the rear surface of the cover 100 toward the inside of the housing 10 is in contact with a sealing member 18 formed in the housing 10 without interfering with the button member 220 of the lever 200. That is, the cover 100 may maximally rotate in the first direction R1 without interference, and accordingly, the hook 141 is fastened to the fastening protrusion 17 of the cover 100 so that the cover 100 may close one region of the housing 10.

In addition, as described above, the fastening member 331 of the holder 300 may be coupled to the accommodation groove 16 formed in the housing 10. Here, the first support member 120 may support the rear surface of the fastening member 331, and the second support member 130 may support the side surface of the holder 300. Specifically, one inclined surface of the first support member 120 may support the rear surface of the holder 300, and the second support member 130 having a semi-circular cross-section may support the side surface of the holder 300.

Accordingly, because the holder 300 mounted with the dust bag 400 may be stably supported by the support members 120 and 130, the dust bag 400 mounted on the holder 300 may be fixed to the same height to prevent the problem of dust leaking from the dust bag 400 even in a case in which the dust bag 400 is full of dust.

In addition, it is possible to prevent a problem of dust being scattered in the housing 10 because the weight of the dust bag 400 full of the dust is not copped with and the coupling of the holder 300 is unintentionally released.

In particular, the support members 120 and 130 are formed in plural at positions corresponding to the fastening members 331, and support all the fastening members 331 disposed at both edges of the locking bar 330, and therefore, even in a case in which the dust is collected to be biased to only one side in the dust bag 400, the effects described above may be exhibited in the same way because the support members 120 and 130 stably support the holder 300.

Hereinafter, a structure in which the cover 100 is interfered by the holder 300 according to an embodiment of the disclosure will be described with reference to FIGS. 9 and 10.

Figure 9:
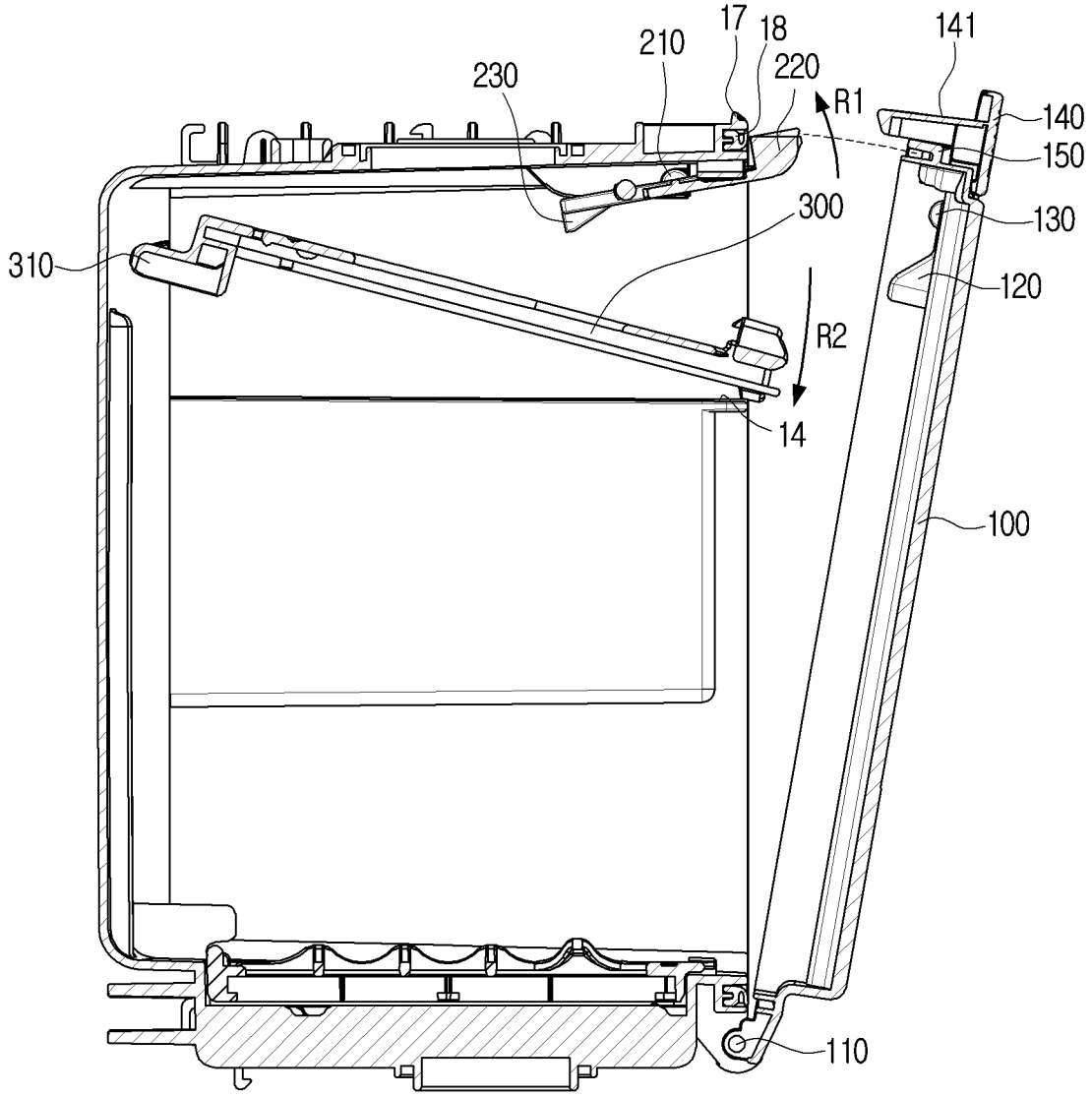
FIG. 9 is a cross-sectional view illustrating the holder in a first position according to an embodiment of the disclosure.

FIG. 9 is a cross-sectional view illustrating the holder 300 in a first position according to an embodiment of the disclosure.

Figure 10:
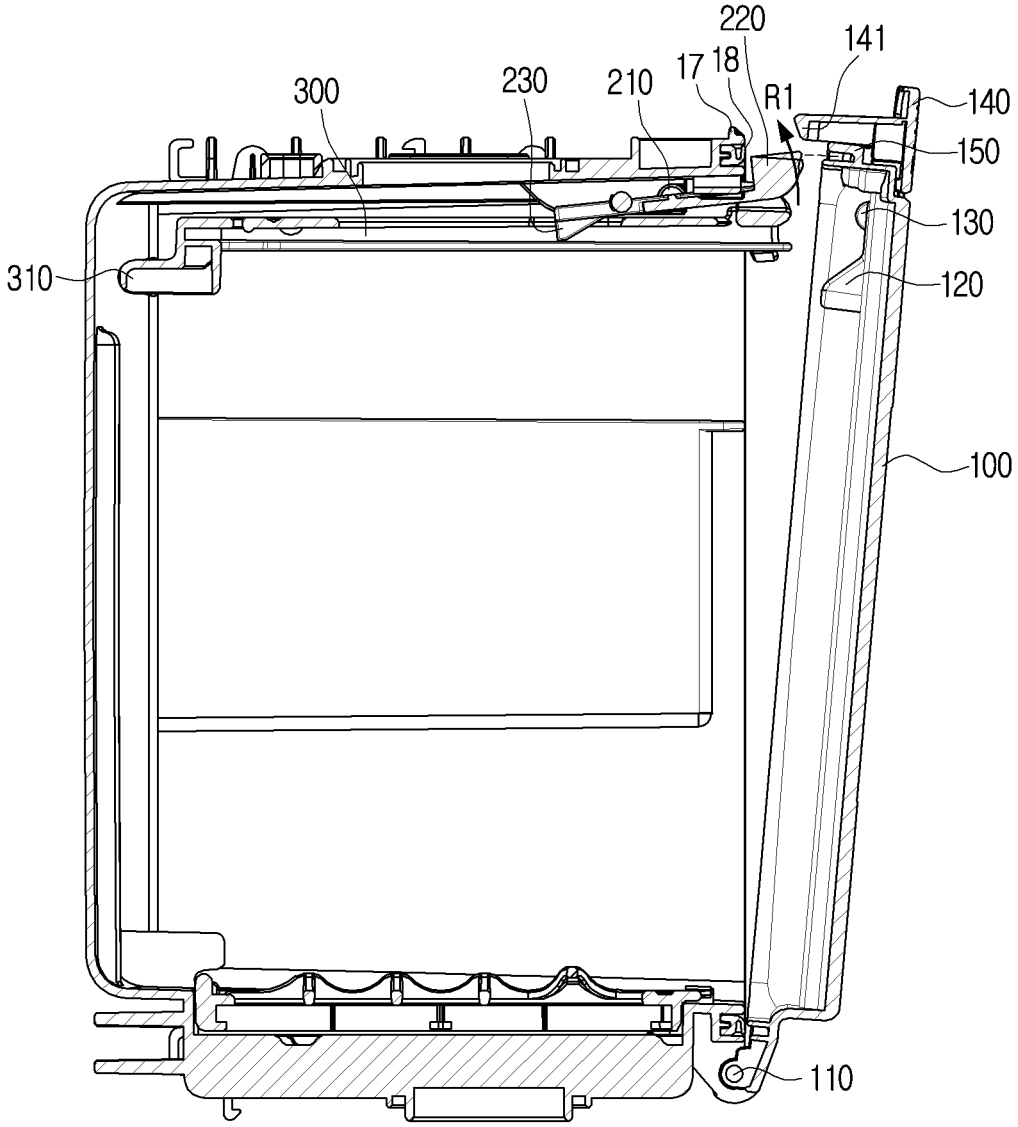
FIG. 10 is a cross-sectional view illustrating the holder in a second position in which the dust bag is not mounted according to an embodiment of the disclosure.

FIG. 10 is a cross-sectional view illustrating the holder 300 in a second position on which the dust bag 400 is not mounted according to an embodiment of the disclosure.

In a case in which the dust bag 400 is replaced, if the user pulls the handle 140 of the cover 100, the cover 100 may be opened by rotating in the second direction R2, and if the user presses the button member 220 of the lever 200, the coupling of the holder 300 and the accommodation groove 16 may be released by being pushed by the lever 200.

In this case, the holder 300 may be rotated to the first position along the second direction R2 about the holder rotation shaft until the lower surface of the holder 300 is in contact with the upper surface 14 of the holder support protrusion 13, and the lever 200 may be rotated in the first direction R1 by an elastic force of a torsion spring.

Specifically, as the holder 300 is rotated in the second direction R2, the inclined member 230 of the lever 200 is no longer subject to interference from the dust bag 400 mounted on the holder 300, and therefore, the lever 200 may be rotated in the first direction R1 to return to an original state by the torsion spring. Accordingly, because the rib 150 of the cover 100 interferes with the button member 220 rotated in the first direction R1, the cover 100 may not close one region of the housing 10.

In addition, referring to FIG. 10, even if the holder 300 on which the dust bag 400 is not mounted is rotated to the second position, because the inclined member 230 of the lever 200 is still not interfered by the dust bag 400, the lever 200 may still be rotated in the first direction R1. Therefore, because the rib 150 of the cover 100 still interferes with the button member 220 of the lever 200, the cover 100 may not close one region of the housing 10.

Therefore, the user may know that the dust bag 400 including the fixing plate 410 is not mounted on the holder 300 or that the dust bag 400 mounted on the holder 300 is not in communication with the accommodation chamber 20 by visually and physically confirming that the cover 100 is not closed.

That is, the station 1 according to an embodiment of the disclosure may structurally recognize whether or not the dust bag 400 is mounted and whether or not the dust bag 400 is in communication with the accommodation chamber 20, and structurally inform the user whether or not the dust bag 400 is mounted and whether or not the dust bag 400 is in communication with the accommodation chamber 20 through the state in which the cover 100 is not closed.

Accordingly, it is possible to prevent the inside of the station 1 from being damaged by the dust scattered due to the dust bag 400 that is not mounted or is not in communication with the accommodation chamber 20. Further, because the station 1 may exhibit the effects described above through a mechanical configuration, it is possible to improve durability of the station 1 and significantly reduce a manufacturing cost thereof.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A station for detachably docking with a dust canister of a vacuum cleaner, the station comprising:

an accommodation chamber configured to dock with the dust canister of the vacuum cleaner;

a housing, including an inner space that communicates with the accommodation chamber, configured to receive a dust bag in the inner space;

a cover configured to:

open and close a region of the housing;

a holder configured to:

be detachable to the dust bag, and selectively enable communication between the dust bag and the accommodation chamber; and an air flow generator configured to provide a driving force for suctioning contents from the dust canister of the vacuum cleaner into the dust bag, wherein the cover is configured to close the region of the housing based on the dust bag being mounted on the holder and the holder being rotated to communicate the dust bag with the accommodation chamber.

2. The station as claimed in claim 1, wherein the holder is configured to rotate toward the accommodation chamber to communicate the dust bag with the accommodation chamber.

3. The station as claimed in claim 1, further comprising:

a lever configured to include one end disposed in the region of the housing, wherein the holder is rotated away from the accommodation chamber based on the one end of the lever being pushed.

4. The station as claimed in claim 1, wherein the cover includes a support member disposed to protrude toward an inside of the housing.

5. The station as claimed in claim 4, wherein the support member includes:

a first support member supporting a lower surface of the holder; and a second support member supporting a side surface of the holder.

6. The station as claimed in claim 4, wherein the holder includes a locking bar in which a fastening member disposed at an edge is coupled to an accommodation groove formed in the housing, and wherein the support member supports the fastening member.

7. The station as claimed in claim 3, wherein the holder includes:

an end rotatably coupled in the housing; and another end coupled to an accommodation groove formed in the housing.

8. The station as claimed in claim 7, wherein the holder is pushed by the lever, based on one pressed end of the lever, to release a fastening with the accommodation groove, and the holder is rotated away from the accommodation chamber.

9. The station as claimed in claim 3, wherein the lever is configured to rotate in a first direction to selectively interfere with the cover, and wherein the cover includes a rib that is disposed to:

protrude toward the inside of the housing; and interfere with the lever rotated in the first direction.

10. The station as claimed in claim 1, wherein the holder includes:

a sliding groove on one surface on which the dust bag is slidingly mounted; and an inclined member having a region disposed in a section in which the dust bag slides and interferes with the dust bag based on the dust bag being mounted on the holder to be rotated away from the accommodation chamber.

11. The station as claimed in claim 10, wherein the inclined member includes a surface formed to be inclined in a direction in which the dust bag slides.

12. The station as claimed in claim 3, wherein the lever is configured to rotate in a first direction to selectively interfere with the cover, and wherein the lever includes a torsion spring that provides an elastic force in the first direction.

13. The station as claimed in claim 1, wherein the cover includes an end rotatably connected to the housing.

14. The station as claimed in claim 1, wherein the air flow generator is further configured to generate air flow from the dust canister of the vacuum cleaner to the dust bag based on the dust canister of the vacuum cleaner being docked with the accommodation chamber.

15. The station as claimed in claim 14, wherein the dust canister of the vacuum cleaner includes a canister cover that opens and closes the region of the housing, and wherein the air flow generator opens the canister cover based on the dust canister of the vacuum cleaner being docked with the accommodation chamber.

16. The station as claimed in claim 3, wherein the lever is configured to:

rotate in a first direction to selectively interfere with the cover, and rotate in a second direction opposite to the first direction to close the cover based on the dust bag being mounted on the holder and in communication with the accommodation chamber.

* * * * *